US010994900B2

(12) United States Patent
Winthrop et al.

(10) Patent No.: US 10,994,900 B2
(45) Date of Patent: May 4, 2021

(54) NOVELTY VESSEL ACCESSORY

(71) Applicants: Kimberly Winthrop, West Palm Beach, FL (US); Neil Winthrop, West Palm Beach, FL (US)

(72) Inventors: Kimberly Winthrop, West Palm Beach, FL (US); Neil Winthrop, West Palm Beach, FL (US)

( * ) Notice: Subject to any disclaimer, the term of this patent is extended or adjusted under 35 U.S.C. 154(b) by 845 days.

(21) Appl. No.: 14/261,170

(22) Filed: Apr. 24, 2014

(65) Prior Publication Data

US 2015/0305530 A1 Oct. 29, 2015

(51) Int. Cl.
*B65D 47/06* (2006.01)

(52) U.S. Cl.
CPC ..... *B65D 47/06* (2013.01); *B65D 2203/00* (2013.01)

(58) Field of Classification Search
CPC ..... B65D 2203/00; B65D 47/06
USPC ..... 222/548, 567; 215/387, 43, 45, 47–19, 215/330, 316; 206/457; 220/716
See application file for complete search history.

(56) References Cited

U.S. PATENT DOCUMENTS 1,559,013 A * 10/1925 Smith ..... B65D 1/0223 215/203
1,797,433 A 3/1931 McCrea et al.
1,881,772 A 10/1932 Maas
2,143,712 A 1/1939 Rissman
2,524,125 A 10/1950 Haid
2,601,040 A 6/1952 Livingtone
3,063,604 A 11/1962 Malpas
3,422,998 A 1/1969 Murray
3,537,623 A 11/1970 Fisher
3,670,915 A 6/1972 Forman
(Continued)

*Primary Examiner* — Anthony D Stashick
*Assistant Examiner* — Raven Collins

(57) ABSTRACT

A novelty vessel accessory may include an external surface having an upper external portion and a lower external portion, a lower opening situated at the bottom of the external surface, and an engaging internal surface substantially concentric to the lower external portion and defining an annulus between the lower external portion and the engaging internal surface. The novelty vessel accessory may include an upper opening situated at the top of the external surface and a conduit internal surface substantially concentric to the upper external portion and defining an annulus between the upper external portion and the conduit internal surface. The novelty vessel accessory may have its external surface formed into an advantageous shape or have an advantageous color. The novelty vessel accessory may include a vessel insertion lip connected to the top of its engaging internal surface and extending down substantially concentric to the engaging internal surface such that the vessel insertion lip and engaging internal surface sandwich the upper portion of the open mouth of the inserted cylindrical vessel. The novelty vessel accessory may also include a flow-control member connected to the top of its engaging internal surface such that fluid exiting the mouth an inserted cylindrical vessel pass through the flow-control member and the top opening. The novelty vessel accessory may also include a removable stopper member engaged with its upper opening, wherein fluids are prevented from exiting the upper opening until the removable stopper member is removed.

14 Claims, 9 Drawing Sheets

(56) References Cited

U.S. PATENT DOCUMENTS

| | | | | |
|---|---|---|---|---|
| 4,044,484 | A * | 8/1977 | Ludder | G09F 3/00 229/5.8 |
| 4,632,265 | A | 12/1986 | Cochrane | |
| 5,131,571 | A | 7/1992 | Nolley | |
| 5,303,850 | A * | 4/1994 | Connan | B65D 47/263 215/253 |
| 6,170,705 | B1 * | 1/2001 | Schneider | B65D 35/12 222/107 |
| 6,857,542 | B1 * | 2/2005 | Mettler | B65D 47/06 222/546 |
| 8,177,085 | B2 | 5/2012 | Hopps | |
| 8,210,375 | B2 | 7/2012 | Heiberger | |
| 8,413,858 | B2 * | 4/2013 | Rasmussen | B01F 3/0446 222/564 |
| 2006/0070972 | A1 * | 4/2006 | Gomer | B65D 41/48 215/254 |
| 2006/0223016 | A1 * | 10/2006 | Hanes | F21S 13/12 431/144 |
| 2010/0012615 | A1 | 1/2010 | Brooks | |
| 2010/0304357 | A1 | 12/2010 | Meyers et al. | |
| 2011/0253666 | A1 | 10/2011 | Keller | |
| 2012/0225166 | A1 * | 9/2012 | Hopps | B65D 23/08 426/106 |
| 2013/0068715 | A1 | 3/2013 | Sakulsacha | |
| 2015/0060499 | A1 * | 3/2015 | Silvers | B65D 47/06 222/481.5 |

* cited by examiner

NOVELTY VESSEL ACCESSORY

FIELD OF THE INVENTION

The present invention relates to the field of fluid vessels and, more specifically, to the field of accessories for fluid vessels, along with associated methods of use.

BACKGROUND OF THE INVENTION

Individuals consume large amounts of fluids that are marketed and sold in vessels that conform to certain size and shape standards. As a non-limiting example, beer is marketed and sold in "longneck" bottles. Many longneck bottles are sold and consumed in social settings. In many of those social settings it would be advantageous for users to have an accessory to adorn their drinking vessel.

Similarly, many potable beverages are sold and consumed in quantities that are far less than the volume the vessel in which such beverages are packaged. As a further non-limiting example, liquor is often sold in 1-to-4-ounce quantities—e.g., mixed with other ingredients in a drink sold at a bar—but is typically packaged and stored in much larger vessels on the order of 1-to-2 liters. In some situations, these larger vessels are stored at great distances from the consuming public, usually so that a server can work in between the customer and the storage vessel, as in a bar or pub environment.

Depending on the distance between the customer and the vessel at the point of sale, it may be difficult for the customer to discern which beverage choices are available, especially in the case where a particular beverage comes in many flavors. Often times, such beverages are stored in vessels that are virtually identical, except for maybe a label that is difficult to read from a distance. An advantageous accessory would permit greater visibility of individual beverage choices in such situations.

BRIEF SUMMARY OF THE INVENTION

In view of the foregoing background, it is therefore an object of the present invention to provide a novelty item for adorning a vessel.

These and other objects, features and advantages in accordance with the present invention are provided by a novelty vessel accessory. The novelty vessel accessory may comprise an external surface having an upper external portion and a lower external portion. The novelty vessel accessory may also comprise an upper opening situated at the top of the external surface, and a lower opening situated at the bottom of the external surface. The novelty vessel accessory may also comprise a conduit internal surface substantially concentric to the upper external portion and defining an annulus between the upper external portion and the conduit internal surface and an engaging internal surface substantially concentric to the lower external portion and defining an annulus between the lower external portion and the engaging internal surface. The engaging internal surface of a novelty vessel accessory according to at least one embodiment of the present invention may include a plurality of flexible concentric raised ridges connected to the novelty vessel accessory's engaging internal surface. A novelty vessel accessory according to embodiments of the present invention may be advantageously configured such that its engaging internal surface engages the outer surface of a cylindrical vessel having an open mouth inserted into the lower opening of the accessory permitting fluid to exit the open mouth of the inserted cylindrical vessel through the accessory's upper opening. Novelty vessel accessories embodying the present invention may have an external surface that bears an advantageous shape or color, or may bear a brand name or logo corresponding to the source of a fluid contained in the vessel. Additionally, novelty vessel accessories according to embodiments of the present invention may further comprise a flow-control member connected to the top of the vessel accessory's engaging internal surface such that fluid exiting the mouth of a cylindrical vessel engaged with the vessel accessory's engaging internal surface pass through the flow-control member and the vessel accessory's upper opening.

DETAILED DESCRIPTION OF THE PREFERRED EMBODIMENTS

The present invention will now be described fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The present invention is now described herein in the context of a novelty vessel accessory, which is suitable for attaching to a longneck beer bottle. Those of ordinary skill in the art will realize that the following embodiments of the present invention are only illustrative and are not intended to be limiting in any way. Other embodiments of the present invention will readily suggest themselves to such skilled persons having the benefit of this disclosure.

Figure 1:
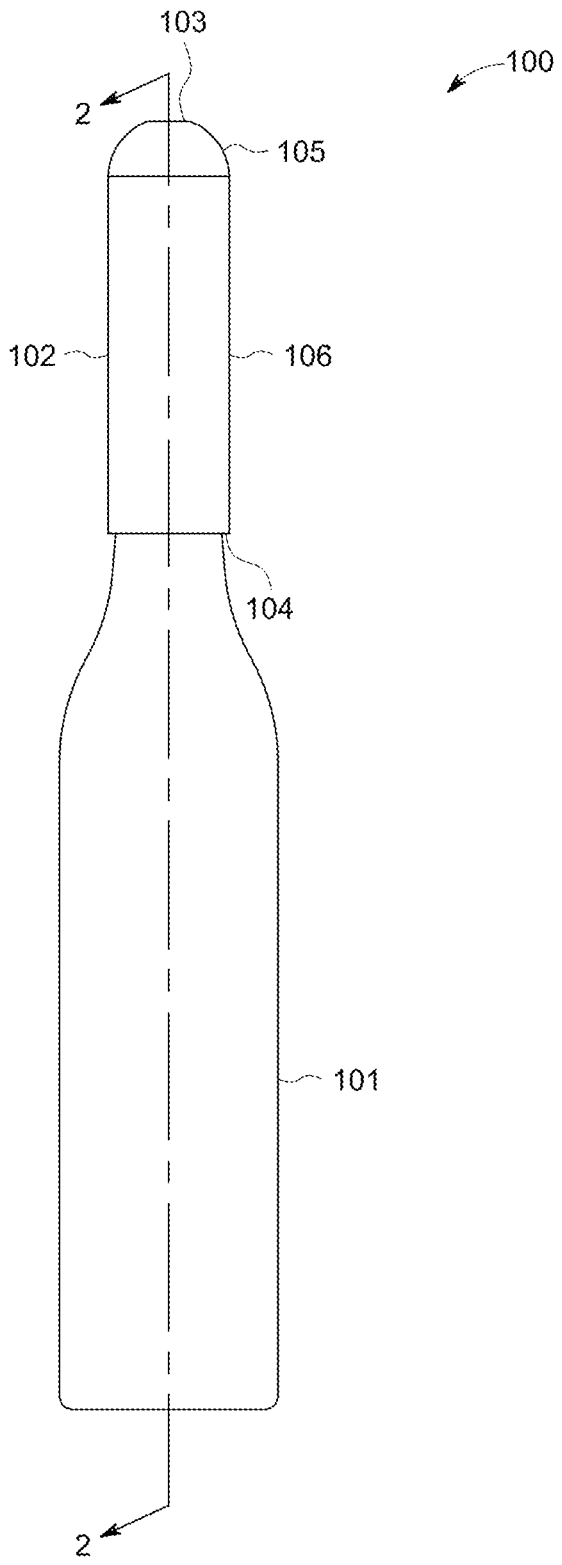
FIG. 1 is a perspective view of a novelty vessel accessory according to an embodiment of the present invention.
Figure 2:
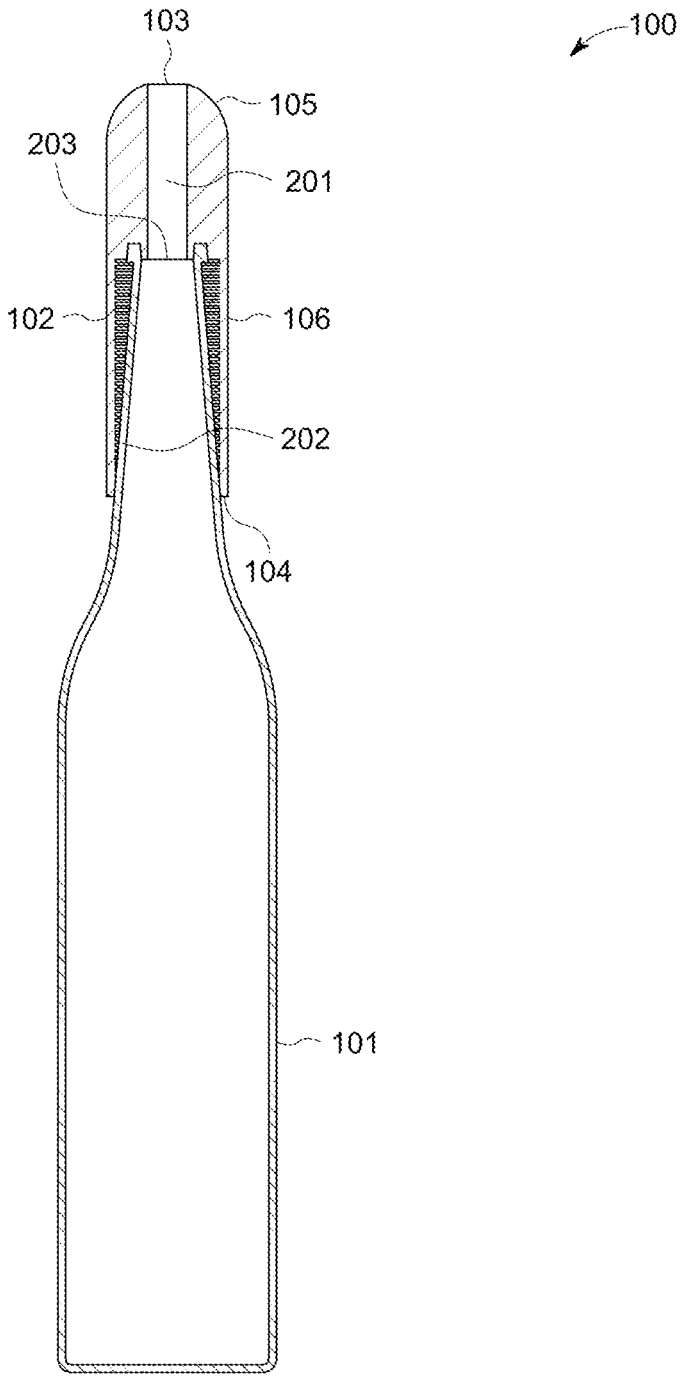
FIG. 2 is a cross-sectional view of a novelty vessel accessory, according to an embodiment of the present invention, taken through the line 2-2 of FIG. 1.
Figure 3:
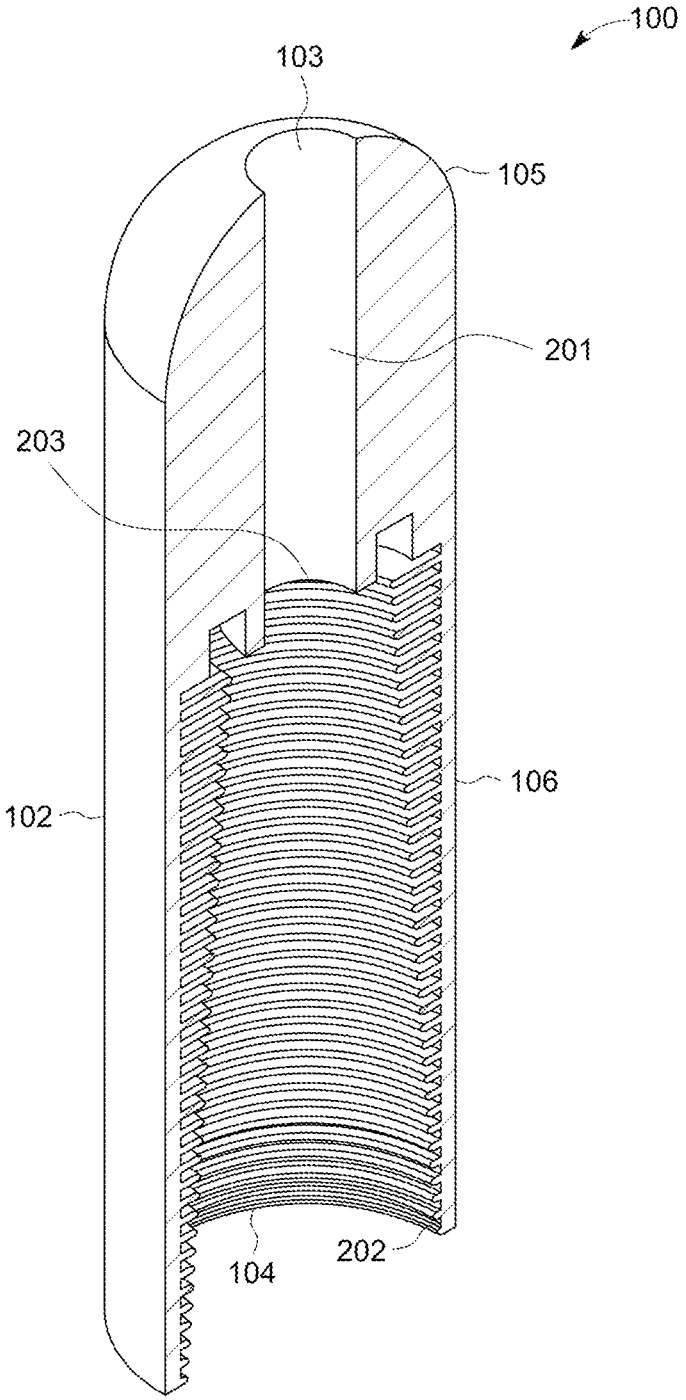
FIG. 3 is an expanded cross-sectional view of a novelty vessel accessory, according to an embodiment of the present invention.

FIG. 1 illustrates a perspective view of a novelty vessel accessory 100, according to an embodiment of the present invention, which may be suitable for adorning a longneck beer bottle 101. FIG. 2 and FIG. 3 respectively illustrate cross-sectional and expanded cross-sectional views of a novel vessel accessory 100. As depicted in FIG. 1, FIG. 2, and FIG. 3, a novel vessel accessory 100 may include an external surface 102 having an upper external portion 105 and a lower external portion 106. A novel vessel accessory 100 may further include a top opening 103 situated at the top of the novel vessel accessory's external surface 102 and a bottom opening 104 situated at the bottom of the novel vessel accessory's external surface 102.

On the interior of a novel vessel accessory 100, as depicted in FIG. 2 and FIG. 3, a conduit internal surface 201 may be provided, which conduit internal surface 201 is substantially concentric to the novel vessel accessory's upper external portion 105 and defining an annulus between the upper external portion 105 and the conduit internal surface 201. A novel vessel accessory 100 may further include an engaging internal surface 202, which is substantially concentric to the novel vessel accessory's lower external portion 106 and defining an annulus between the lower external portion 106 and the engaging internal surface 202. According to one or more embodiments of the present invention, a novel vessel accessory's engaging internal surface 202 engages the outer surface of a longneck beer bottle 101 that is inserted into the novel vessel accessory's bottom opening 104. Once engaged with a novelty vessel's engaging internal surface 202, a longneck beer bottle's contents may exit the bottle's open mouth through the top opening 103 through the annulus defined by the novel vessel accessory's upper external portion and its conduit internal surface. A novelty vessel accessory's engaging internal surface 202 may be textured to improve its ability to provide a watertight seal when engaged upon a compatible vessel. As a non-limiting example, a plurality of flexible raised ridges may be connected to a novelty vessel accessory's engaging internal surface 202.

A novel vessel accessory 100, according to embodiments of the present invention, may be fabricated from a semi-firm flexible material. By way of non-limiting example, novel vessel accessories may be fabricated from thermoplastic elastomer, silicone, plastic, silicone, rubber, polyurethane, polyurethane rubber, foamed polyurethane, flexible epoxy, or other similar materials. A person having skill in the relevant art will appreciate that such materials are well-suited for fabricating a novel vessel accessory 100 that may be stretched slightly when engaged upon a compatible vessel to create a water-tight seal between the novelty vessel accessory's engaging internal surface 202 and the exterior of the vessel. A person having skill in the relevant art would also appreciate that concentric raised ridges connected to the engaging internal surface 202 of a novelty vessel accessory fabricated from such materials would be flexible and would therefore flex in the direction of insertion when a user inserted a vessel 101 into the novelty vessel accessory's bottom opening 104. Similarly, such a skilled person would understand and appreciate that once so inserted, the vessel would not rotate in relation to the engaging internal surface 202 of a novelty vessel accessory 101, and would instead be held fast by the flexed ridges, creating a water-tight seal. A novel vessel accessory 100 might have a rigid core member having a conical shaped, which may be made of, for example, but not limited to, engineering plastic or metal.

Figure 4:
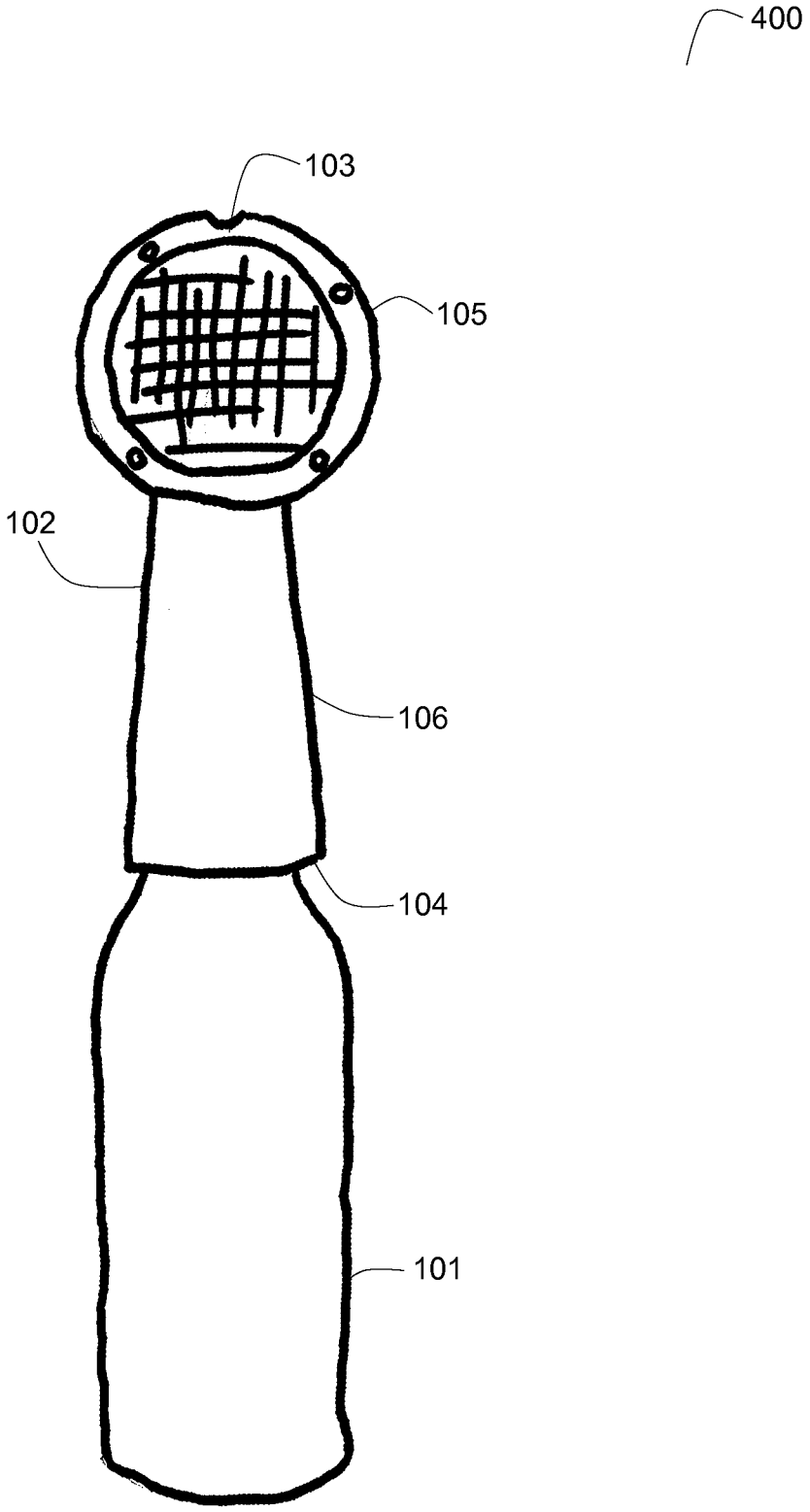
FIG. 4 is a perspective view of a novelty vessel accessory according to an embodiment of the present invention.

According to embodiments of the present invention, a novelty vessel accessory 100 may have an external surface 102 that has been fabricated to have an advantageous shape. By way of illustrative example only, and not provided as a limitation, a novelty vessel accessory 100 may have the shape of a human phallus. By way of further illustrative example, and not provided as a limitation, a novelty vessel accessory 400 may have the shape of a microphone, as depicted in FIG. 4.

In at least one embodiment of the present invention, a novel vessel accessory 100 may also include a vessel insertion lip 203, which is connected to the top of the novel vessel accessory's engaging internal surface 202 and which extends down substantially concentric to the engaging internal surface 202. A vessel insertion lip 203 and engaging internal surface 202, according to embodiments of the present invention, may sandwich the open mouth of a compatible vessel that is inserted into the lower opening 104.

Figure 5:
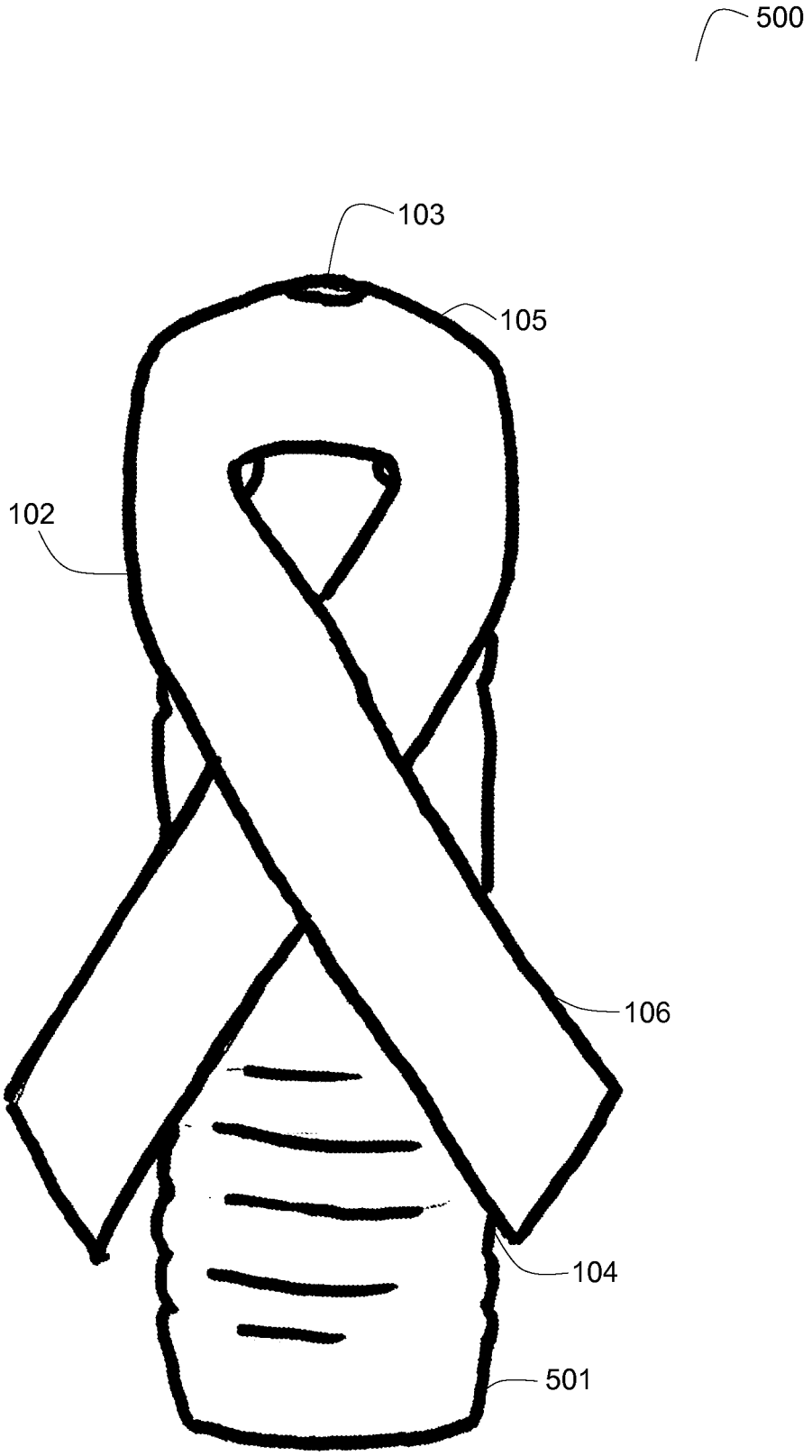
FIG. 5 is a perspective view of a novelty vessel accessory according to an embodiment of the present invention.

As depicted in FIG. 5, a novelty vessel accessory 500, according to embodiments of the present invention, may be configured to interface with a plastic water bottle 501, and its external surface may be advantageously shaped to resemble a ribbon as is typically used in connection with a variety of charitable causes. A novelty vessel accessory shaped as a charity ribbon may be colored to signify a particular recognizable charity cause.

The present invention is now described herein in the context of a novelty vessel accessory, which is suitable for attaching to a larger bottle, such as, by way of non-limiting example, a liquor or wine bottle. Those of ordinary skill in the art will realize that the following embodiments of the present invention are only illustrative and are not intended to be limiting in any way. Other embodiments of the present invention will readily suggest themselves to such skilled persons having the benefit of this disclosure.

Figure 6:
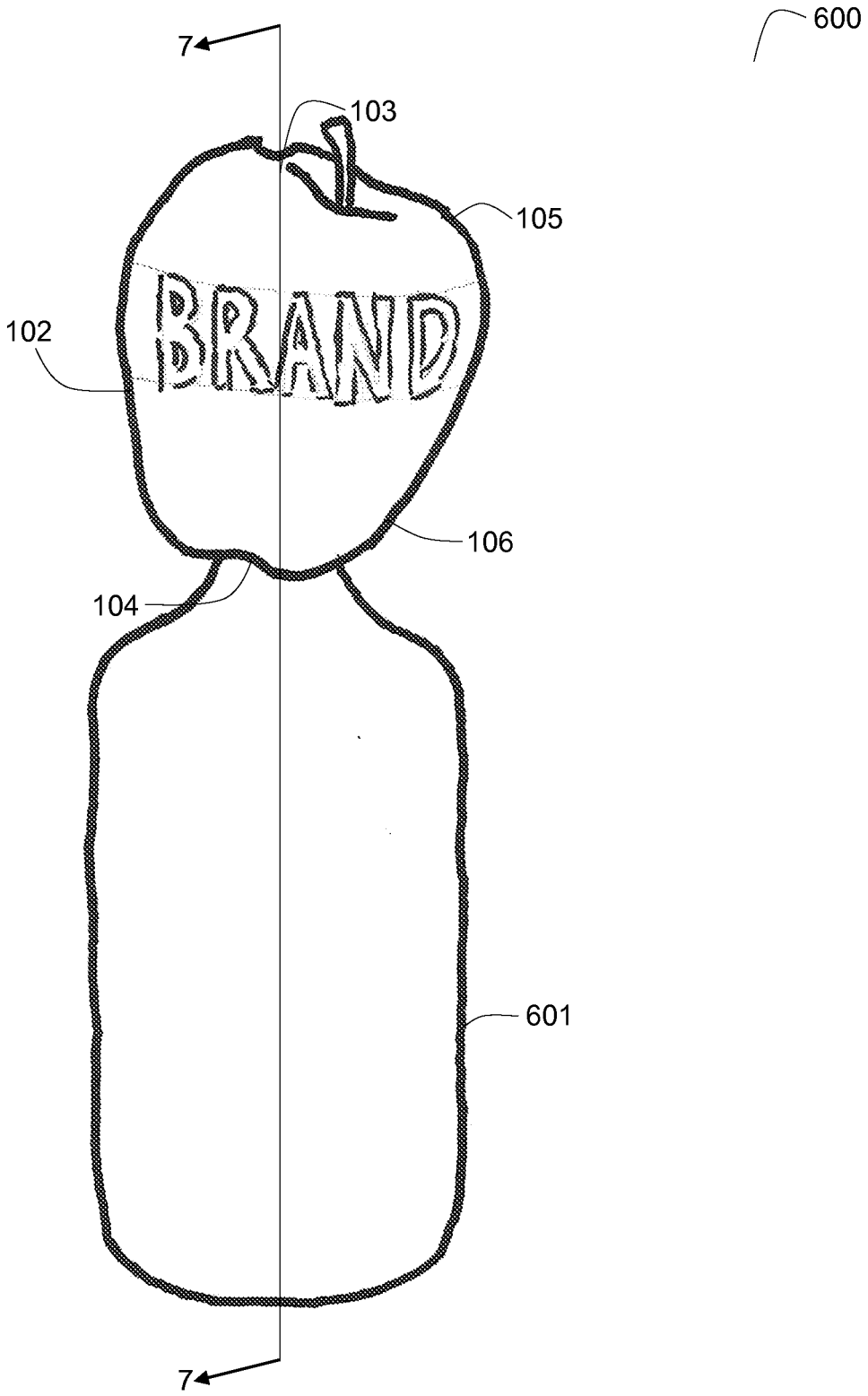
FIG. 6 is a perspective view of a novelty vessel accessory according to an embodiment of the present invention.
Figure 7:
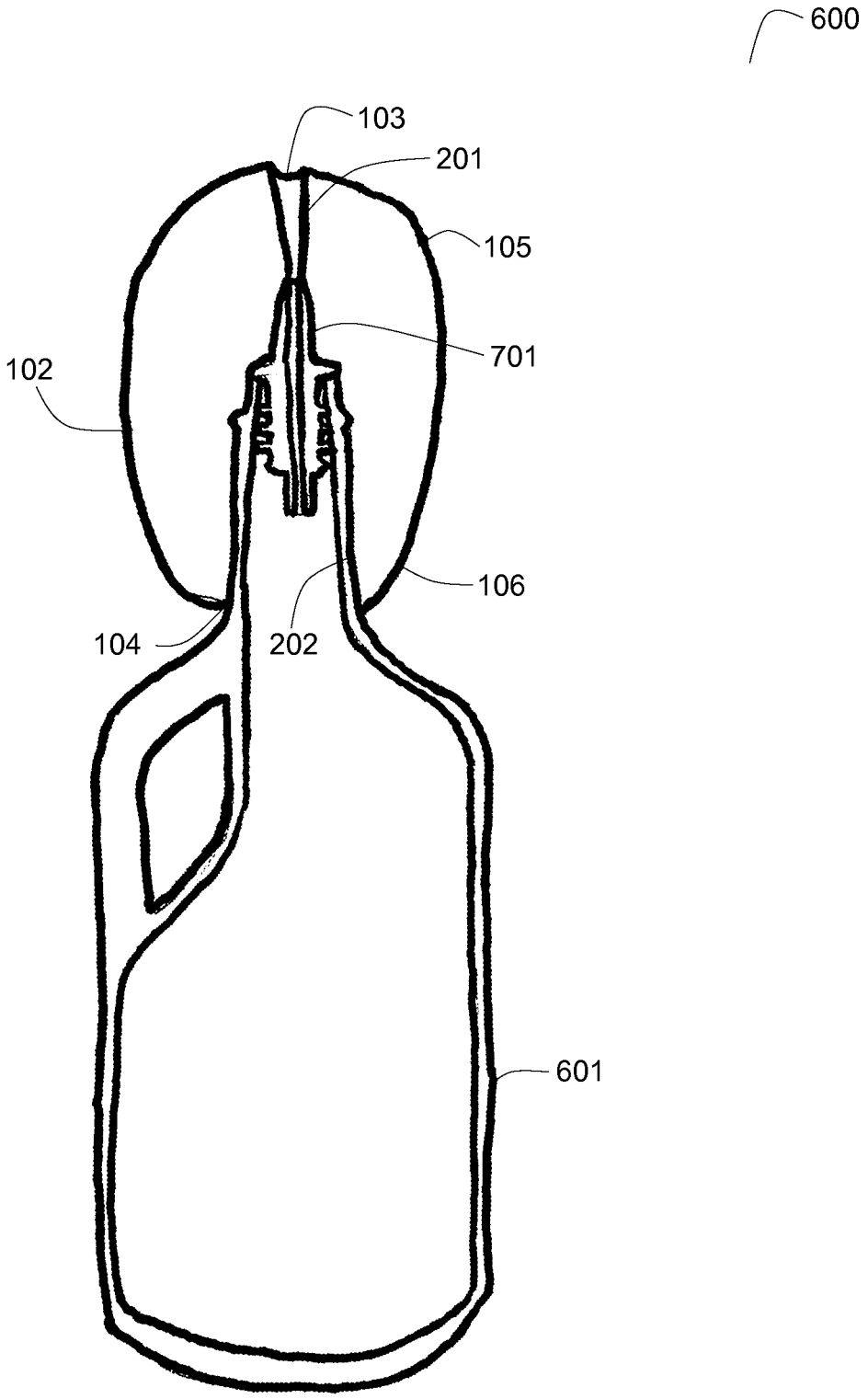
FIG. 7 is a cross-sectional view of a novelty vessel accessory, according to an embodiment of the present invention, taken through the line 7-7 of FIG. 6.

FIG. 6 illustrates a perspective view of a novelty vessel accessory 600, according to an embodiment of the present invention, which may be suitable for adorning a liquor bottle 601. FIG. 7 illustrates a cross-sectional view of a novel vessel accessory 600. As depicted in FIG. 6 and FIG. 7, a novel vessel accessory 600 may include a flow-control member 701 connected to the top of the novel vessel accessory's engaging internal surface 202. In this configuration, fluids contained in a liquor bottle 601 may exit the bottle's mouth, then pass through the flow-control member 701, and then through the novel vessel accessory's top opening 103. According to embodiments of the present invention, a flow-control member 701 may include an electronic flow-control device that is configured to measure the amounts of fluid poured from a bottle 601. Those of ordinary skill in the relevant art will appreciate that such flow-control devices may be configured to interrupt the flow of liquid once a certain volume has been reached.

According to embodiments of the present invention, a novelty vessel accessory's external surface 102 may have an advantageous shape that corresponds to the flavor of a fluid stored in an engaged cylindrical vessel 601. In certain embodiments of the present invention, a novelty vessel accessory's external surface 102 may have an advantageous color, which may correspond to the flavor of a fluid stored in an engaged cylindrical vessel 601. Novelty vessel accessories, according to embodiments of the present invention, may have a visible brand name or logo on its external surface 102, which brand name or logo may correspond to the source of a fluid stored in an engaged cylindrical vessel 601. Those of ordinary skill in the relevant art will recognize that lighting devices, such as light emitting diodes, may be embedded under a novelty vessel accessory's external surface 102 to improve the visibility of the novelty vessel accessory in low light environments.

Figure 8:
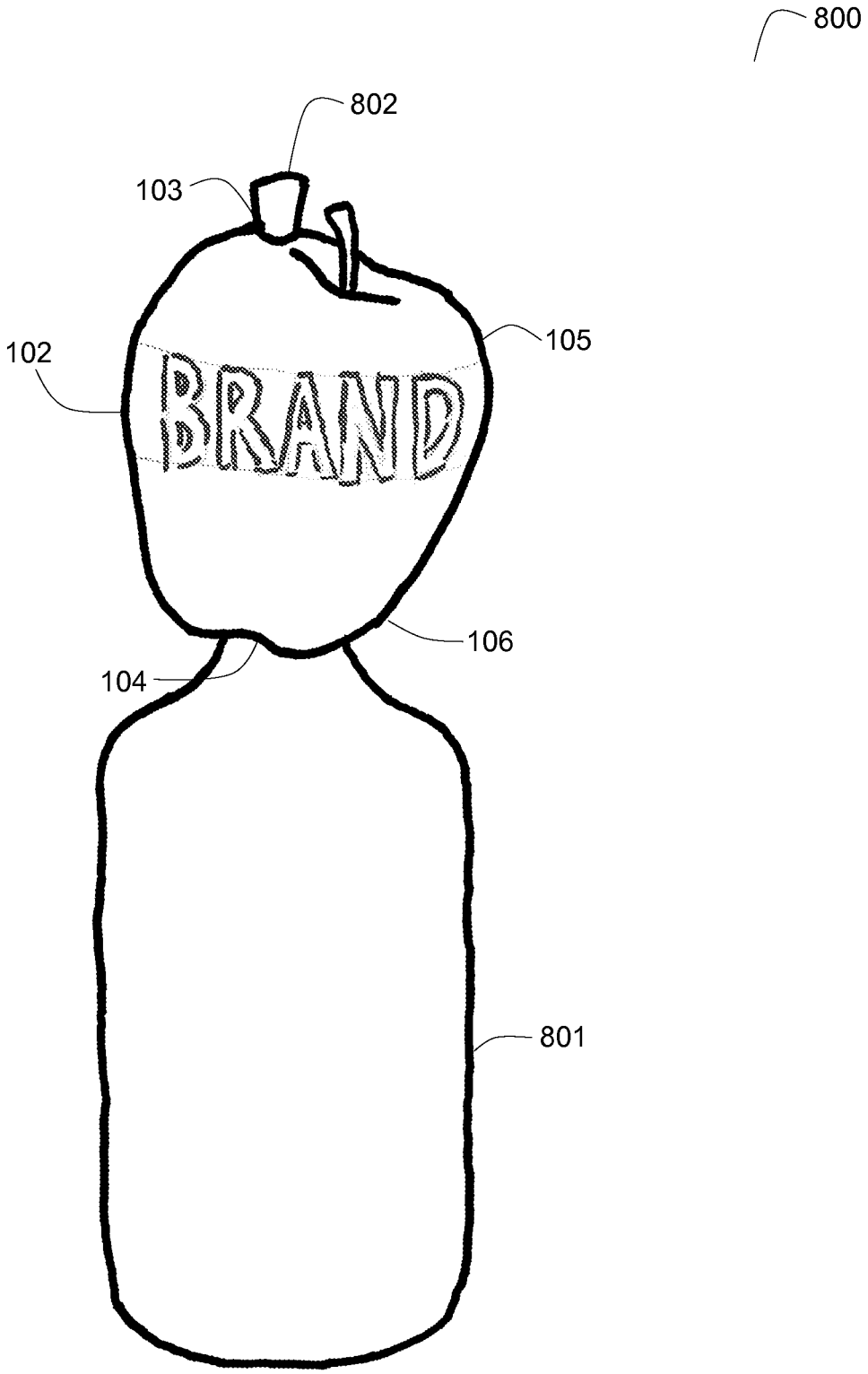
FIG. 8 is a perspective view of a novelty vessel accessory according to an embodiment of the present invention.

Turning now to FIG. 8, a perspective view of a novelty vessel accessory 800 is illustrated according to embodiments of the present invention, which is suitable for adorning a liquor or wine bottle 801. As depicted in FIG. 8, a novel vessel accessory 800 may include a removable stopper member 802 engaged with the novel vessel accessory's upper opening, wherein fluids are prevented from exiting the novelty vessel accessory's upper opening 103 until said removable stopper member is removed.

Figure 9:
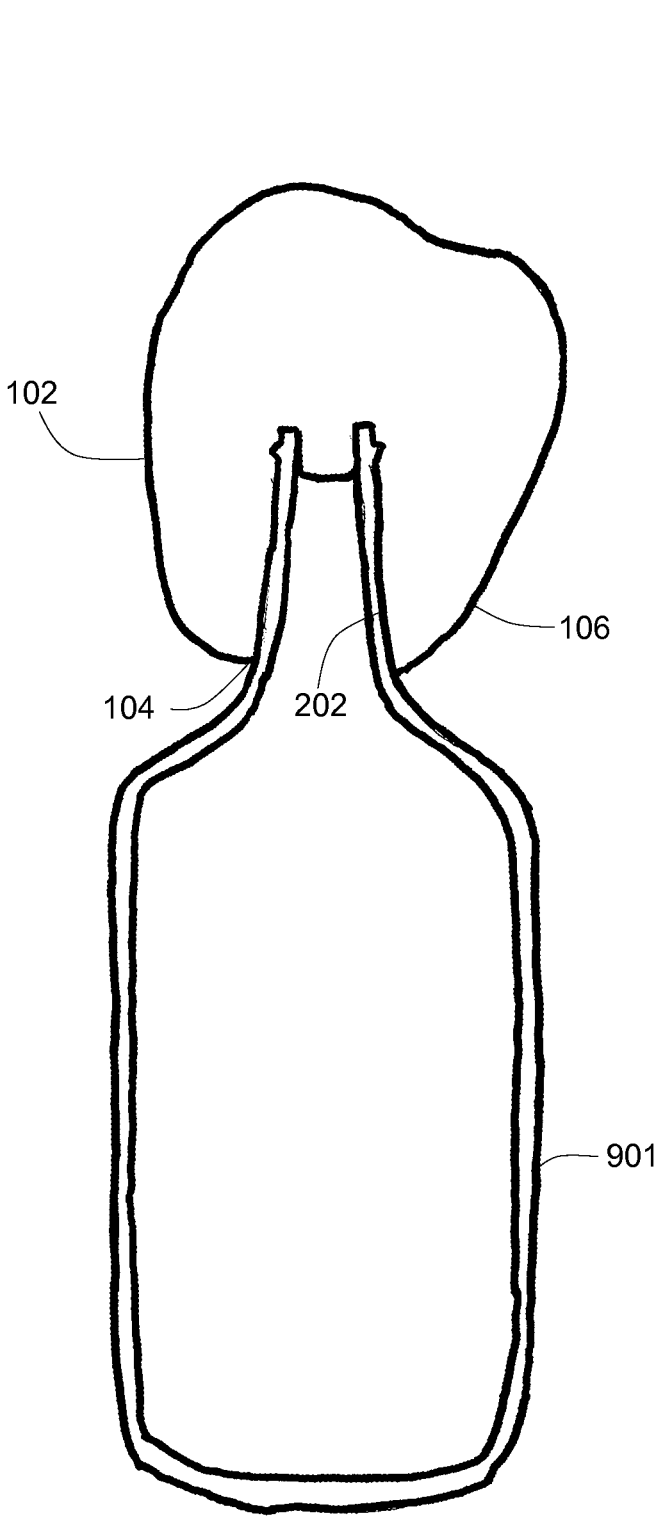
FIG. 9 is a cross-sectional view of a novelty vessel accessory, according to an embodiment of the present invention.

As depicted in FIG. 9, a novelty vessel accessory 900 may be configured without an upper opening. According to such embodiments of the present invention, a novelty vessel accessory 900 may be advantageously configured to engage the open mouth of an inserted wine or liquor bottle 901, such that fluids are prevented from exiting the bottle 901 until the novelty vessel accessory is removed.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed.

That which is claimed is:

1. A novelty vessel accessory comprising:

an external surface having an upper external portion and a lower external portion;

a lower opening situated at the bottom of said external surface;

an engaging internal surface substantially concentric to said lower external portion and defining an annulus between said lower external portion and said engaging internal surface;

a plurality of flexible concentric raised ridges connected to the engaging internal surface;

wherein said raised ridges non-rotationally engage the smooth outer surface of a cylindrical vessel having an open mouth inserted into said bottom opening and flex in the direction of insertion to form a water-tight seal with said smooth outer surface of said cylindrical vessel.

2. The novelty vessel accessory of claim 1 further comprising:

an upper opening situated at the top of the external surface;

a conduit internal surface substantially concentric to the upper external portion and defining an annulus between said upper external portion and said conduit internal surface;

wherein a fluid contained in a cylindrical vessel having an open mouth inserted into said bottom opening is permitted to exit the open mouth of said inserted cylindrical vessel through said upper opening.

3. The novelty vessel accessory of claim 2 wherein the external surface resembles a human phallus.

4. The novelty vessel accessory of claim 2 wherein the external surface resembles a microphone.

5. The novelty vessel accessory of claim 2 wherein the advantageous shape resembles a charity ribbon.

6. The novelty vessel accessory of claim 2 wherein the external surface corresponds to the flavor of a fluid contained in the cylindrical vessel.

7. The novelty vessel accessory of claim 1 wherein the color of the external surface corresponds to the flavor of a fluid contained in the cylindrical vessel.

8. The novelty vessel accessory of claim 1 wherein a brand name corresponding to a source of a fluid contained in the cylindrical vessel appears on the external surface.

9. The novelty vessel accessory of claim 1 wherein a logo corresponding to a source of a fluid contained in the cylindrical vessel appears on the external surface.

10. The novelty vessel accessory of claim 1 further comprising a vessel insertion lip connected to the top of the engaging internal surface and extending down substantially concentric to said engaging internal surface such that said vessel insertion lip and said engaging internal surface sandwich the upper portion of the open mouth of said inserted cylindrical vessel.

11. The novelty vessel accessory of claim 2 further comprising a flow-control member connected to the top of the engaging internal surface such that fluid exiting the mouth an inserted cylindrical vessel pass through said flow-control member and the top opening.

12. The novelty vessel accessory of claim 11 wherein the flow-control member comprises an electronic flow-control device.

13. The novelty vessel accessory of claim 2 further comprising a removable stopper member engaged with the upper opening, wherein fluids are prevented from exiting said upper opening until said removable stopper member is removed.

14. The novelty vessel accessory of claim 1 wherein the shape of the external surface corresponds to the flavor of a fluid contained in the cylindrical vessel.

* * * * *